US009108093B2

(12) United States Patent
Johnson

(10) Patent No.: US 9,108,093 B2
(45) Date of Patent: Aug. 18, 2015

(54) APPARATUS FOR CARRYING AND SUPPORTING GOLF CLUBS AND ACCESSORIES

(71) Applicant: David Wayne Johnson, Prior Lake, MN (US)

(72) Inventor: David Wayne Johnson, Prior Lake, MN (US)

(73) Assignee: Practice Club Caddy LLC, Burnsville, MN (US)

( * ) Notice: Subject to any disclaimer, the term of this patent is extended or adjusted under 35 U.S.C. 154(b) by 153 days.

(21) Appl. No.: 13/896,983

(22) Filed: May 17, 2013

(65) Prior Publication Data

US 2013/0306503 A1 Nov. 21, 2013

Related U.S. Application Data

(60) Provisional application No. 61/648,396, filed on May 17, 2012.

(51) Int. Cl.

| | |
|---|---|
| ***A63B 55/10*** | (2006.01) |
| *A63B 55/00* | (2015.01) |
| *A63B 55/02* | (2006.01) |
| *A63B 55/04* | (2006.01) |
| *A63B 71/02* | (2006.01) |

(52) U.S. Cl.

CPC ..... *A63B 55/10* (2013.01); *A63B 55/008* (2013.01); *A63B 55/02* (2013.01); *A63B 55/04* (2013.01); *A63B 2071/024* (2013.01); *A63B 2071/026* (2013.01); *A63B 2225/09* (2013.01); *A63B 2225/682* (2013.01)

(58) Field of Classification Search

CPC .. A63B 55/10; A63B 55/02; A63B 2225/682; A63B 55/008; A63B 2071/026; A63B 55/04; A63B 2071/024; A63B 2225/09

USPC ..... 473/282; 211/70.2; 206/315.2

See application file for complete search history.

(56) References Cited

U.S. PATENT DOCUMENTS

| | | | | |
|---|---|---|---|---|
| 1,826,216 | A * | 10/1931 | Johnson | 206/315.6 |
| 2,577,333 | A * | 12/1951 | Klum | 211/70.2 |
| 2,661,175 | A * | 12/1953 | Holder | 248/96 |
| 3,269,683 | A | 8/1966 | Shinaver | |
| 3,570,795 | A * | 3/1971 | Benzel | 248/96 |
| 3,784,138 | A | 1/1974 | Herling et al. | |
| 3,966,051 | A * | 6/1976 | Hollister et al. | 211/14 |
| 4,459,827 | A | 7/1984 | Rhodes | |
| 4,550,930 | A | 11/1985 | Proffit | |
| 4,697,780 | A | 10/1987 | Salzmann et al. | |
| 4,819,843 | A | 4/1989 | Nakayama | |
| 4,844,399 | A | 7/1989 | Harm | |
| 4,875,579 | A | 10/1989 | Tak | |
| 4,889,267 | A | 12/1989 | Bolton | |
| 5,105,958 | A | 4/1992 | Patton | |

(Continued)

OTHER PUBLICATIONS

EZ Sprts, Inc.; EZ Caddie; Product advertised Nov. 2006; Accessed Aug. 19, 2013; http://www.ezcaddie.com/home.htm.

(Continued)

*Primary Examiner* — Tri Mai

(74) *Attorney, Agent, or Firm* — Adams Grumbles, LLP; Brittany Nanzig

(57) ABSTRACT

An apparatus for carrying golf clubs and a beverage while practicing allows ease of movement with only a few clubs and a beverage for quicker and more productive practice. The apparatus has self-supporting aspects to allow the apparatus to be used in all areas of a practice range.

8 Claims, 6 Drawing Sheets

(56) References Cited

U.S. PATENT DOCUMENTS

| | | | | |
|---|---|---|---|---|
| 5,152,489 | A | | 10/1992 | Christensen et al. |
| 5,190,257 | A | | 3/1993 | Allen et al. |
| 5,244,114 | A | | 9/1993 | Traegde |
| 5,272,890 | A | | 12/1993 | Penxa |
| 5,301,519 | A | | 4/1994 | Howorka |
| 5,320,263 | A | | 6/1994 | Kobylack |
| 5,409,154 | A | | 4/1995 | Blount |
| 5,417,334 | A | * | 5/1995 | Wu ..... 211/70.2 |
| 5,433,361 | A | | 7/1995 | O'Malley |
| 5,450,991 | A | * | 9/1995 | Neading ..... 224/578 |
| 5,480,078 | A | | 1/1996 | Bean et al. |
| 5,484,128 | A | | 1/1996 | Franco, Sr. |
| 5,484,129 | A | | 1/1996 | Megal |
| 5,494,248 | A | | 2/1996 | Garychuk et al. |
| 5,564,605 | A | | 10/1996 | Heidbreder |
| 5,579,968 | A | | 12/1996 | Staschiak |
| 5,599,037 | A | | 2/1997 | Spickler |
| 5,657,957 | A | | 8/1997 | Graham |
| 5,678,740 | A | | 10/1997 | Wang |
| 5,722,253 | A | | 3/1998 | Todd |
| 5,752,634 | A | | 5/1998 | Kortman |
| 5,769,219 | A | | 6/1998 | Shimel |
| 5,799,967 | A | | 9/1998 | Lin |
| 5,823,496 | A | | 10/1998 | Foley et al. |
| 5,857,684 | A | | 1/1999 | Liao et al. |
| 5,915,551 | A | | 6/1999 | Vavro |
| 6,094,936 | A | | 8/2000 | Miller |
| 6,170,787 | B1 | | 1/2001 | Morgan |
| 6,283,418 | B1 | * | 9/2001 | Kerspilo et al. ..... 248/96 |
| 6,325,350 | B1 | | 12/2001 | Mancuso |
| 6,732,823 | B2 | | 5/2004 | Furuta |
| 6,983,918 | B1 | | 1/2006 | Leasure |
| 7,100,397 | B1 | | 9/2006 | Gratteau |
| D547,922 | S | | 7/2007 | Liao |
| 7,275,668 | B1 | * | 10/2007 | Carroll ..... 224/190 |
| 7,735,202 | B2 | | 6/2010 | Duda et al. |
| 7,997,595 | B1 | | 8/2011 | Pope |
| 2003/0094390 | A1 | | 5/2003 | Goetz et al. |
| 2003/0184053 | A1 | | 10/2003 | Jacobs |
| 2004/0232017 | A1 | | 11/2004 | Felton |
| 2006/0243768 | A1 | | 11/2006 | Dowell |
| 2007/0267454 | A1 | | 11/2007 | Baiz |
| 2008/0146367 | A1 | | 6/2008 | Cruz |
| 2010/0051633 | A1 | | 3/2010 | Collins et al. |

OTHER PUBLICATIONS

J. C. Livingston & Co.; The Golf Butler~Golf Club Holder; Product advertised Oct. 1995; Accessed Aug. 19, 2013; http://www.topgolfsales.com/store/the-golf-butler-golf-club-holder-caddy/.

Dewstick; The Dew Stick; Product advertised Apr. 2010; Accessed Aug. 19, 2013; http://dewstick.com/index.html.

* cited by examiner

APPARATUS FOR CARRYING AND SUPPORTING GOLF CLUBS AND ACCESSORIES

CROSS-REFERENCE TO RELATED APPLICATIONS

This application claims the benefit of U.S. Provisional Application Ser. No. 61/648,396, titled MEANS TO CARRY GOLF CLUBS AND A BEVERAGE FOR PRACTICING, filed May 17, 2012.

BACKGROUND OF THE INVENTION

When practicing the sport of golf, a person may have to lay golf clubs or beverages on the playing surface. This elevates the risk of the clubs getting wet or the beverage spilling. Excess moisture on golf clubs can result in unnecessary corrosion or other damage to clubs or to certain types of golf grips. Further, moisture on the surface of a club head can affect performance of the club.

Club rules of decorum and proper cleanliness or waste disposal may require the need for easy and convenient transport of beverages without placement on the ground. A spilled beverage, such as soda, beer, or even ice, on a golf course or practice space can negatively impact the turf.

Also, golf bags hold an entire set of clubs when only a few are taken to the practice area.

There is a need for an easier way to carry a few clubs, rather than an entire set, while practicing to assist in keeping clubs safe and dry. Further, there is a need for the clubs to be supported in an upright position for easy and convenient retrieval and use.

BRIEF SUMMARY OF THE INVENTION

The present disclosure relates to an apparatus for carrying and supporting golf clubs and a beverage while practicing the sport of golf. The ease of movement with only a few clubs and a beverage will allow a user to have a quicker and more productive practice session. The self-supporting aspects of embodiments of the invention allow the apparatus to be used in all areas of a practice range.

DETAILED DESCRIPTION

Figure 1:
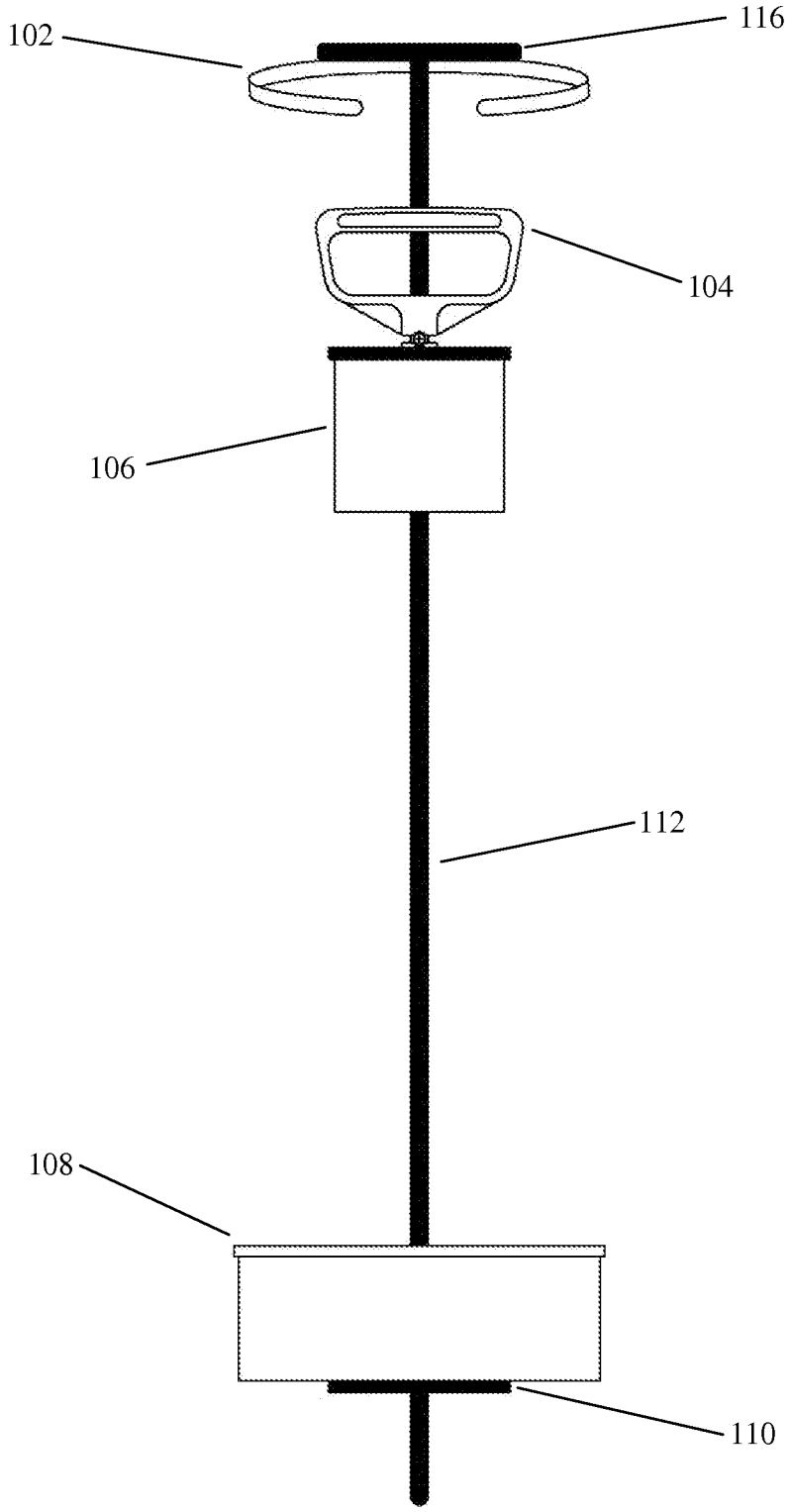
FIG. 1 is a front view of one embodiment of the apparatus described herein.

The apparatus disclosed herein is described by reference to the text and figures below. Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims. It is understood that various omissions and substitutions of equivalents are contemplated as circumstances may suggest or render expedient, but these are intended to cover applications or embodiments without departing from the spirit or scope of the claims attached hereto. Also, it is to be understood that the phraseology and terminology used herein are for the purpose of description and should not be regarded as limiting.

With use of the present invention, a user will not have to lay golf clubs or beverages on the ground (which elevates likelihood of the clubs getting wet or spilling the beverage). The clubs and beverage are stored upright in a self-supporting apparatus that is easy to carry and mobile. Use of the invention prevents excess moisture from harming a user's golf clubs by holding the clubs off of the ground, and helps to prevent spilling of a user's beverage, thereby preventing negative impacts to the playing surface.

Traditional golf bags can be big and cumbersome, and do not allow easy movement around a practice area. This apparatus combines carrying and storage of golf clubs and accessories, such as a beverage. These features have not been provided in a mobile, stable, self-supporting manner before.

The ease of movement with only a few clubs and a beverage provided by the apparatus described herein will allow quicker and more productive practice. The self-supporting aspects allow the apparatus to be used in all areas of the practice range.

In addition, the apparatus can provide much easier use of clubs and beverage contains by those with impaired mobility, such as the aged, disabled or others with reduced physical abilities. For some, setting clubs or beverages on the ground and retrieving may not be physically possible. The apparatus can prevent or reduce the need for such potentially difficult physical motions.

Figure 2:
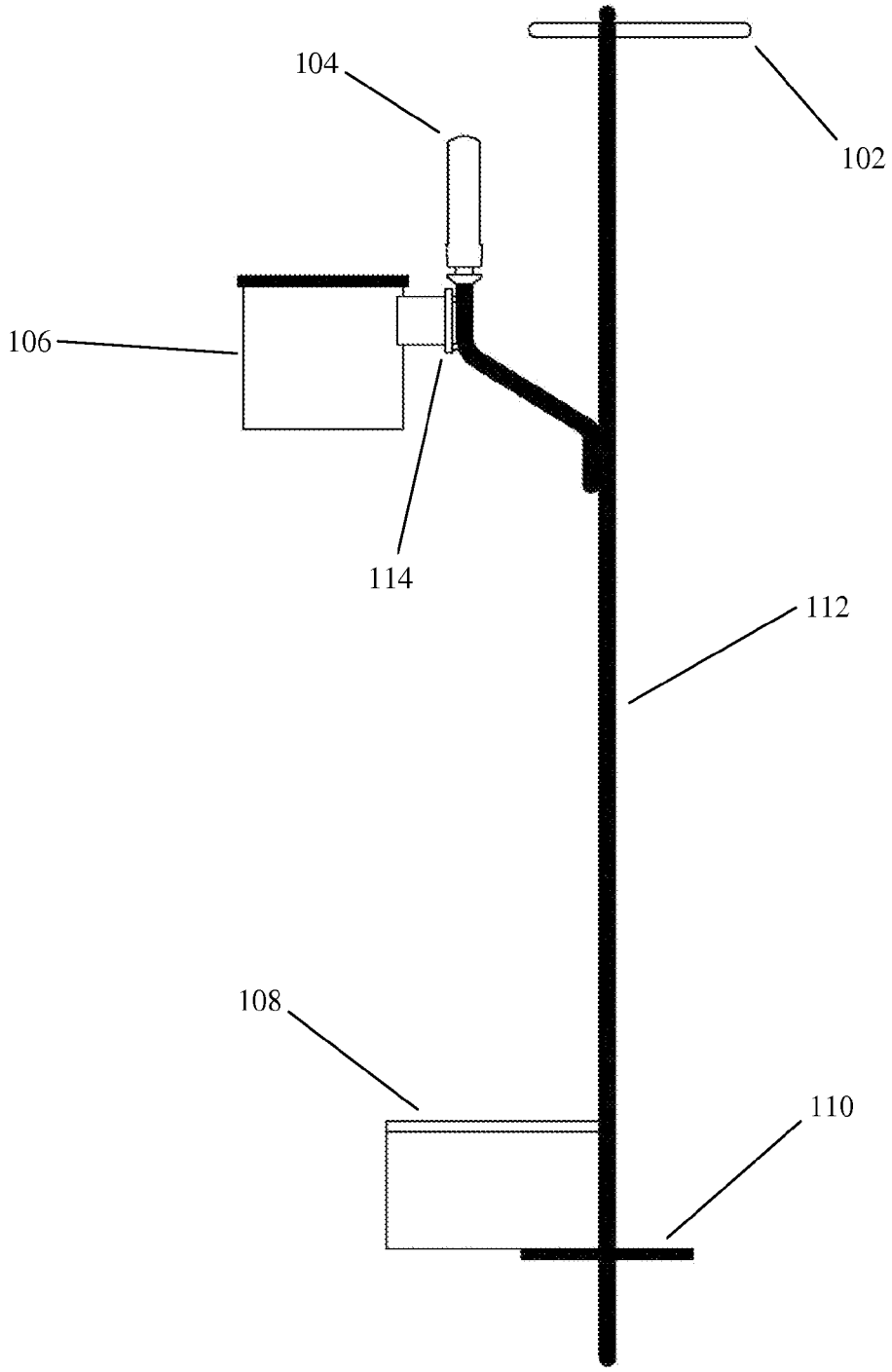
FIG. 2 is a side view of one embodiment of the apparatus described herein.

As illustrated in FIG. 1 and FIG. 2, in one embodiment, the apparatus described herein is comprised of an open-ended enclosure such as a top ring 102, a carrying handle 104, a storage container in the form of a beverage holder 106, a storage container in the form of a club basket 108, a push pad 110, a center support post 112, and a beverage holder attachment plate 114. The top ring 102 is connected to the top of the center support post 112. The club basket 108 and push pad 110 are connected to the bottom of the center support post 112. The carrying handle 104 is connected to the middle of the center support post 112. The beverage holder attachment plate 114 is connected to the carrying handle 104. The beverage holder 106 is held in place by the beverage holder attachment plate 114.

The apparatus may be comprised of metal, plastic, or any other durable, rigid material. The material used may be a sealed, coated material to prevent corrosion or rust. In some embodiments, the apparatus may be comprised of a combination of materials; for example, in one embodiment, the top ring 102, club basket 108, center support post 112 and beverage holder attachment plate 114 maybe comprised of metal, and in the same embodiment the carrying handle 104, beverage holder 106 and push pad 110 may be comprised of a rigid plastic material.

The components of the apparatus may be connected by any means known in the art, for example, metal components may be connected by welding. As a further example, metal and/or plastic components may be attached by screws or other hardware. Once the metal parts are procured they may be rolled, spot welded and welded into position. The handle and beverage holder may be bolted into place. As a further example, the components may be forged or otherwise integrated when manufacturing the apparatus in such a way that the apparatus is manufactured as one piece. In some embodiments, all components are permanently affixed together. In some embodiments, the components may be removably attached. For example, the apparatus may be used without the beverage holder 106.

Figure 5:
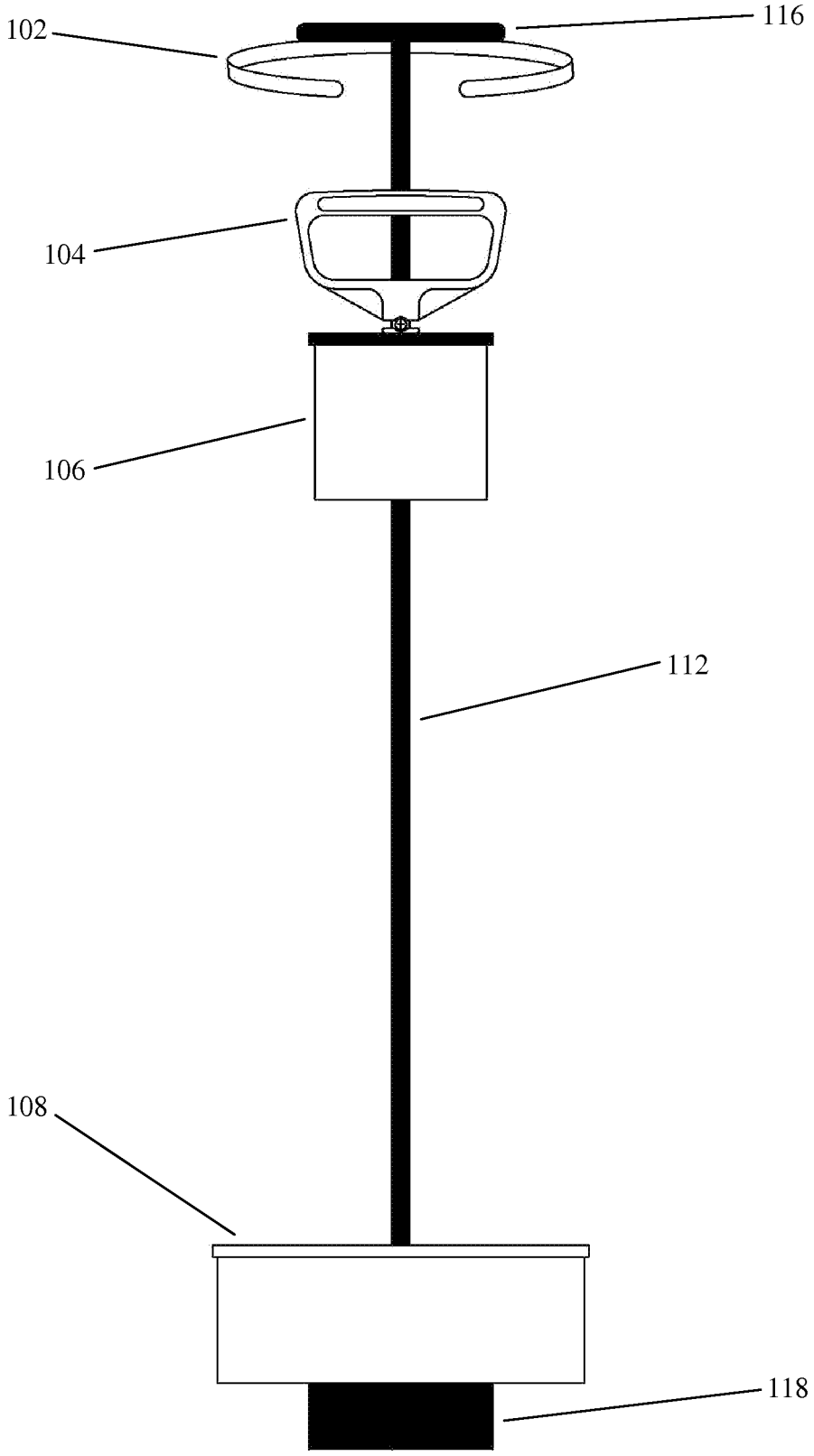
FIG. 5 is a front view of one embodiment of the apparatus described herein.

In some embodiments, the apparatus has self-supporting features and can stand upright without external support. In some embodiments, the center post 112 terminates in a spike at one end, and the apparatus is able to stand upright by driving the center support post 112 into the ground. The user steps upon the push pad 110 to drive the center support post 112 into the ground, allowing the apparatus to stand upright. As illustrated in FIG. 5, the apparatus may further include a weighted base 118 connected to the bottom end of the center support post 112 to add to the self-supporting feature. In other embodiments, the apparatus may further include multiple ends at the bottom that may be driven into the ground using the push pad 110 to provide a more stable upright position. In some embodiments, the end of the center support post 112 that extends beyond the push pad 110 and club basket 108 may be removable for storage purposes.

Figure 3:
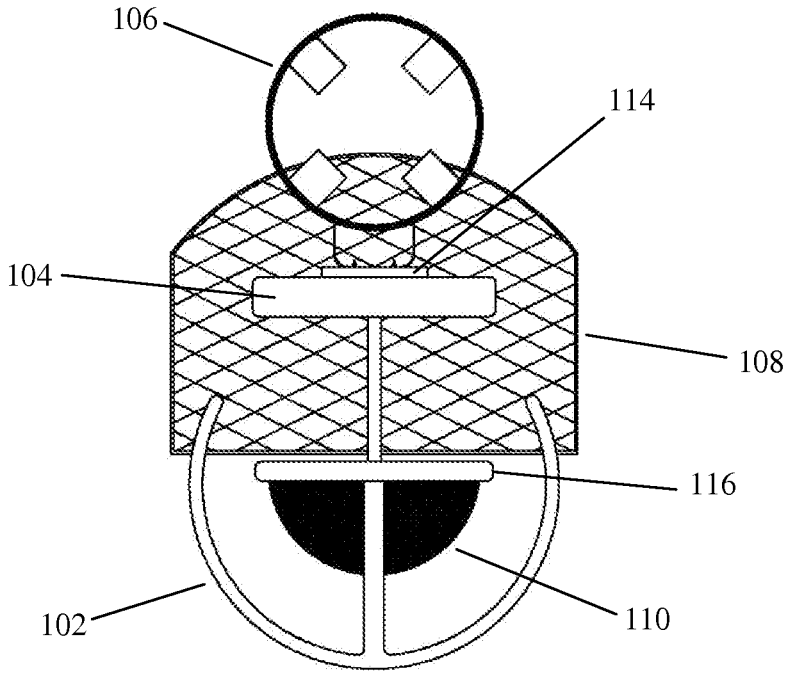
FIG. 3 is a top view of one embodiment of the apparatus described herein.

As illustrated in FIG. 2 and FIG. 3, the components of the apparatus are configured in such a way that the apparatus is balanced, providing support to the apparatus. In the embodiment illustrated in FIG. 2 and FIG. 3, the storage container in the form of a beverage holder 106 and storage container in the form of a club basket 108 are configured at the front portion of the apparatus, whereas the top ring 102 and push pad 110 are configured at the back portion of the apparatus to offset the weight of each component and add to the self-supporting feature.

Figure 4:
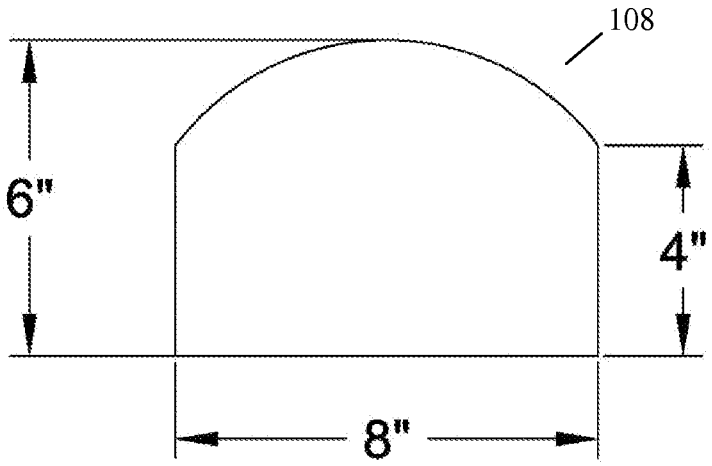
FIG. 4 is an illustration of one example club basket according to one embodiment of the apparatus described herein.

The club basket 108 may be of varied shapes and dimensions. FIG. 4 illustrates one possible example of the shape and dimensions that may be used for the club basket 108. In other examples, the club basket 108 may be rectangular, square, circular or another shape.

In one embodiment, the center support post 112 may be in the form of a pole. The center support post 112 may have the ability to fold with a joint and a release device. In other embodiments, the center support post 112 may be rigid and telescoping. The center support post 112 may include a locking mechanism or rely on friction to maintain an extended position. The height of the apparatus may vary based on the height of the clubs to be used with the apparatus. For example, there may be a children's version that is shorter in height than an adult version. The center support post 112 may further include rings or another type of attaching mechanism to include a strap for carrying the apparatus.

Figure 6:
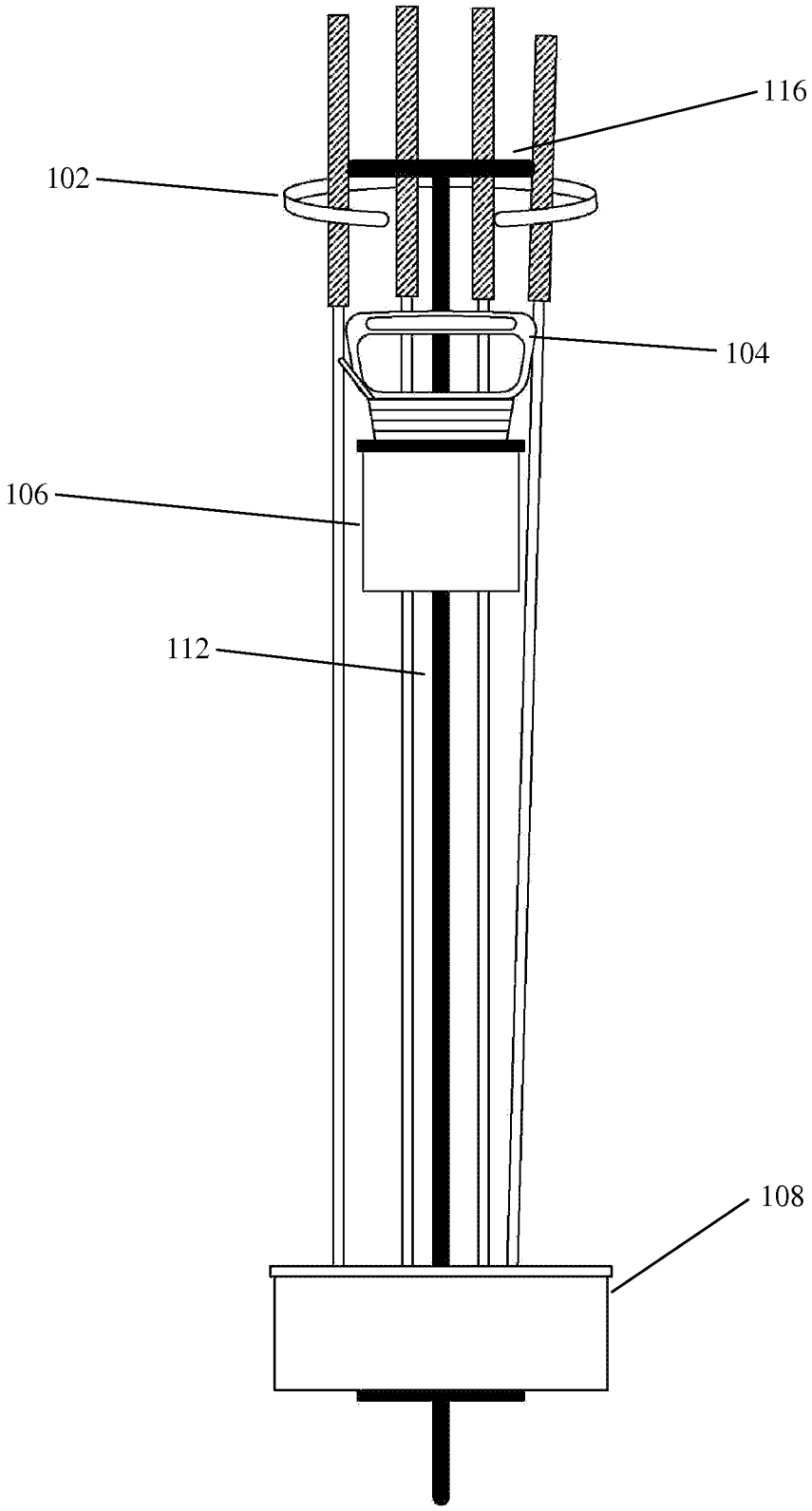
FIG. 6 is a front view of one embodiment of the apparatus described herein, wherein the apparatus is shown in use with golf clubs and a beverage.

In using the apparatus, a user inserts a golf club shaft into the top ring 102 and a club head into the club basket 108, as illustrated in FIG. 6. This allows secure transport when the apparatus is carried by the carrying handle 104. In some embodiments, for example, the embodiment illustrated in FIG. 1, FIG. 3 and FIG. 6, the apparatus includes an open-ended enclosure in the form of a top ring 102 with an arc or round shape and further includes a cross bar 116 configured within the rounded top ring 102. This configuration allows for more security of golf clubs in the apparatus. The top ring 102 and cross bar 116 may be configured in such a way that, because of the nature and shape of a golf club handle and shaft, a user would be required to lift the golf club upward to line up the thinnest portion of the golf club shaft with the gap between the top ring 102 and cross bar 116 to remove the club from the apparatus. The golf club would not be able to fall out of the apparatus due to the limited space between the top ring 102 and the cross bar 116. In some embodiments, the open-ended enclosure may be a rectangular or other shape.

The beverage holder 106 allows a non-spilling option to store a user's beverage when hitting practice shots. The width or size of the beverage holder 106 may be tailored to fit standard cans or bottles. In some embodiments, the beverage holder 106 may be made of some type of flexible material, or may contain flexible material, a rubber lip or flexible tabs to accommodate other sizes. The bottom of the beverage holder 106 might be open in some embodiments, or, alternatively, might include support tabs to secure a beverage. In some embodiments, the bottom of the beverage holder 106 may be comprised of mesh or another material, such as a wire or metal grid, to allow liquids to exit freely if spilled.

In some embodiments, the beverage holder may be replaced by a cup or other removable drinking receptacle. The receptacle may be insulated to keep a beverage cold or hot, and may be customizable. Alternatively, the beverage holder may be an insulated ring that can be snapped on or off of the apparatus. The beverage holder 106 may be square, rectangular, round or any other shape to accommodate a beverage. The beverage holder 106 may alternatively be used to carry golf balls. In some embodiments, the beverage holder 106 may be replaced by a designated holding device for golf balls.

Figure 7:
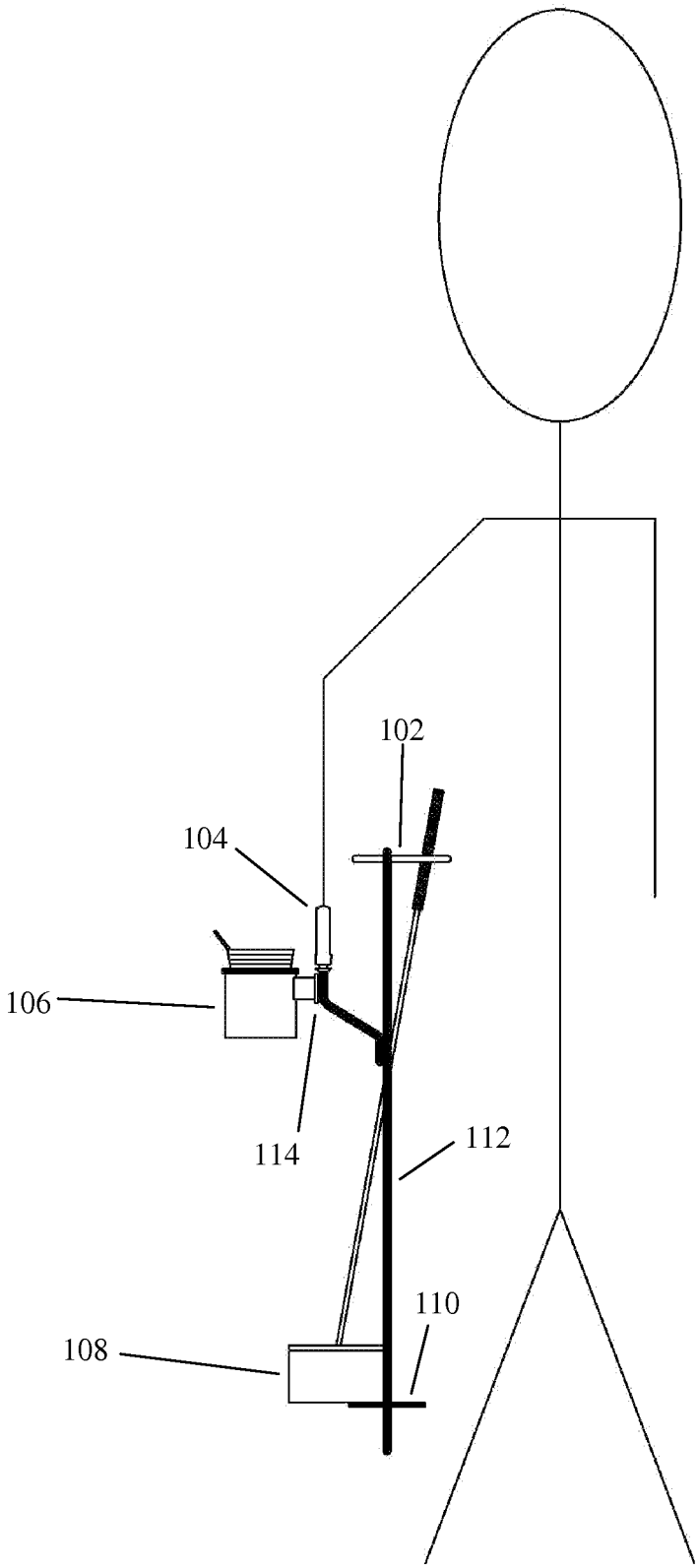
FIG. 7 is an illustration depicting one embodiment of the apparatus described herein being transported by a user.

Once practice clubs are stored in the apparatus, it can be carried to the practice area, as illustrated in FIG. 7, and secured in the ground using the push pad 110 and stabilized with the center support post 112 and club basket 108. This allows for easy transportation of practice clubs and storage of a beverage in the beverage holder 106. The ability to move around a practice area without picking up clubs or a beverage off the ground provides a great convenience to users of the apparatus.

The various embodiments described above are provided by way of illustration only and should not be construed to limit the claims attached hereto. Those skilled in the art will readily recognize various modifications and changes that may be made without following the example embodiments and applications illustrated and described herein and without departing from the true spirit and scope of the following claims.

The invention claimed is:

1. An apparatus for transport and storage of golf clubs, comprising:

a front portion;

a back portion;

a support post having a distal end and a proximal end, wherein the support post is in the form of a pole and terminates in a spike at the distal end;

a circular push pad attached and adjacent to the distal end of the support post, wherein the push pad is perpendicular to the support post;

a club basket comprising:

a rigid base;

a rigid side; and an open top;

wherein the club basket is attached above the push pad to the distal end of the support post;

wherein the rigid base of the club basket has a plurality of openings and is configured to hold a plurality of golf club heads; and wherein the club basket is configured at the front portion of the apparatus;

a rigid handle connected near a middle portion of the support post, wherein the handle projects outward from the front portion of the apparatus;

a beverage holder attachment plate connected to the rigid handle;

a beverage holder attached to the beverage holder attachment plate and configured at the front portion of the apparatus, the beverage holder comprising:

a rigid side; and an open top;

an open-ended enclosure attached perpendicularly to the support post, wherein the open-ended enclosure is in the form of a top ring with an opening and is configured at the back portion of the apparatus; and a cross bar attached perpendicularly to the proximal end of the support post and encompassed within the top ring, wherein the cross bar forms a partially enclosed segment of the top ring and an open segment of the top ring to prevent a golf club from falling through the opening of the top ring.

2. The apparatus of claim 1, wherein the plurality of openings is formed from lattice slats.

3. The apparatus of claim 1, wherein the beverage holder is circular in shape.

4. The apparatus of claim 1, wherein the beverage holder further comprises a rigid base.

5. The apparatus of claim 4, wherein the rigid base is a rigid grid.

6. The apparatus of claim 1, wherein the beverage holder further comprises a rigid support near a base of the beverage holder.

7. The apparatus of claim 6, wherein the rigid support is a plurality of rigid tabs that project inward.

8. The apparatus of claim 1, wherein the top ring and the circular push pad are configured to offset the weight of the beverage holder and the club basket, which are configured at the front portion of the apparatus.

* * * * *